US005393208A

United States Patent [19]

Sbarounis

[11] Patent Number: 5,393,208

[45] Date of Patent: Feb. 28, 1995

[54] TWO-LOBE ROTOR ROTARY MACHINE

[76] Inventor: Joaseph A. Sbarounis, 3061 Tree Chop Rd., Norfolk, Va. 23513

[21] Appl. No.: 250,917

[22] Filed: May 31, 1994

[51] Int. Cl.[6] ..... F01C 1/02

[52] U.S. Cl. ..... 418/54; 418/60

[58] Field of Search ..... 418/5, 60, 61.2, 54

[56] References Cited

U.S. PATENT DOCUMENTS

| | | | |
|---|---|---|---|
| 1,340,625 | 5/1920 | Planche . | |
| 4,167,375 | 9/1979 | Doshi | 418/54 |
| 4,300,874 | 11/1981 | Georgiev . | |
| 5,193,502 | 3/1993 | Lansing | 418/54 |

*Primary Examiner*—Richard A. Bertsch
*Assistant Examiner*—Charles G. Freay
*Attorney, Agent, or Firm*—Peter J. Van Bergen

[57] ABSTRACT

A rotary machine includes a housing with spaced apart end walls for defining a chamber. A two-lobe lenticular rotor assembly is disposed in the chamber for eccentric rotation therein. A hole passes through a central portion of the rotor assembly. Four slots are cut in one end of the rotor assembly in a symmetric arrangement about the center of the rotor assembly. Each slot has two edges defining an open end continuous with the hole so that each slot extends radially outward from the hole. A rotor guide assembly includes two generally cylindrical guide posts of radius R. Each guide post extends in parallel fashion toward the slots in the rotor assembly so that the guide posts can engage the slots during eccentric rotation of the rotor assembly. A shaft extends through the hole with its center longitudinal axis offset from the center of the rotor assembly by an offset distance OD. The shaft's eccentric bearing(s) reside within the rotor assembly while the shaft extends through the chamber and is rotatably mounted in each end wall. The shaft is centered between the guide posts such that the shaft's center longitudinal axis and the guide posts' center longitudinal axes are in coplanar alignment. The distance from the shaft's center longitudinal axis to each guide posts' center longitudinal axis is equal to the offset distance OD. The hole is sized so that a distance between the rotor assembly center to each edge of each open end of the slots is equal to $$\sqrt{2\,(OD)^2 + R^2}\,.$$

17 Claims, 7 Drawing Sheets

TWO-LOBE ROTOR ROTARY MACHINE

FIELD OF THE INVENTION

The invention relates generally to rotary machines, and more particularly to a gearless, two-lobe rotor rotary machine for rotating a shaft or for being driven by a rotating shaft.

BACKGROUND OF THE INVENTION

Gearless rotary machines operating as positive displacement machines, e.g., either pumps or engines, date back to the early 1900's. For example, U.S. Pat. No. 1,340,625 teaches a rotary machine having a two-lobe lenticular rotor provided with slots which., when the rotor rotates, engage fixed guide members mounted on the machine housing. The slotted rotor construction requires that the machine's rotating shaft be supported completely from one side of the rotor. However, for high speed rotary machines, considerable stresses necessitate that the single shaft support bearing be substantial, i.e., heavy.

In U.S. Pat. No. 4,300,874, a rotary machine includes a slotted rotor for engagement with a large single guide member and a rectangular portion of the shaft that passes therethrough. A first slot accommodates the guide member and a second slot perpendicular to the first slot accommodates the rectangular portion of the shaft. The rotor slidingly contacts the guide member and the rectangular portion of the shaft during eccentric rotation. However, centrifugal forces from the eccentric motion of the rotor are transmitted in alternate fashion between the guide member and the rectangular portion of the shaft thereby causing forces to be concentrated at the various points of contact. This is the source of friction and wear as rotational speed increases.

SUMMARY OF THE INVENTION

Accordingly, it is an object of the present invention to provide an improved rotary machine capable of functioning as either a pump or an engine.

Another object of the present invention is to provide a gearless rotary machine for operation at high rotational speeds while offering increased resistance to wear.

Yet another object of the present invention is to provide a gearless two-lobe rotor rotary machine that reduces rotor mass.

Other objects and advantages of the present invention will become more obvious hereinafter in the specification and drawings.

In accordance with the present invention, a rotary machine includes a housing with spaced apart end walls for defining a chamber. A two-lobe lenticular rotor assembly is disposed in the chamber for eccentric rotation therein. The rotor assembly has curved faces meeting at symmetrically opposed apices and two parallel end faces extending between the curved faces. Each end face faces one of the end walls. A hole passes through a central portion of the rotor assembly. Four slots are cut in one of the end faces in a symmetric arrangement about the center of the rotor assembly. Each slot has two edges defining an open end continuous with the hole so that each slot extends radially outward from the hole. A rotor guide assembly, extending from one of the end walls, includes first and second guide posts. Each guide post is cylindrical in shape over at least a substantial portion thereof and is defined by a radius R over the substantial portion. Each guide post extends in parallel fashion toward the end face with the slots so that the guide posts can engage the slots during eccentric rotation of the rotor assembly. A shaft extends through the hole with its center longitudinal axis offset from the center of the rotor assembly by an offset distance OD. The shaft's eccentric bearing(s) reside within the rotor assembly while the shaft extends through the chamber and is rotatably mounted in each end wall. The shaft is centered between the guide posts such that the shaft's center longitudinal axis and the guide posts' center longitudinal axes are in coplanar alignment. The distance from the shaft's center longitudinal axis to each guide posts' center longitudinal axis is equal to the offset distance OD. The hole is sized so that a distance between the rotor assembly center to each edge of each open end of the slots is equal to $$\sqrt{2\,(OD)^2 + R^2}\ .$$

DETAILED DESCRIPTION OF THE INVENTION

Figure 1:
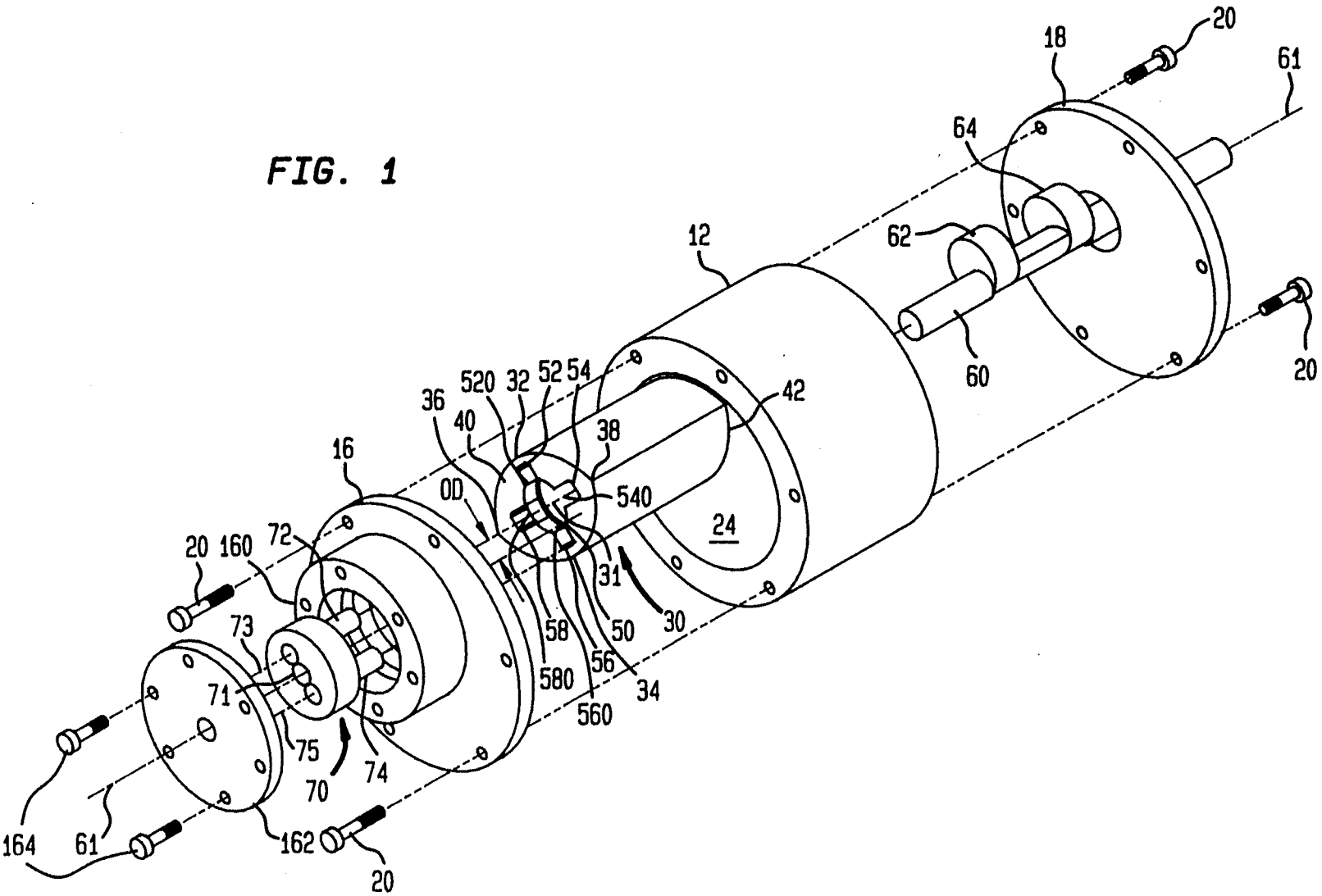
FIG. 1 is an exploded perspective view of the gearless two-lobe rotor rotary machine according to the present invention.
Figure 2:
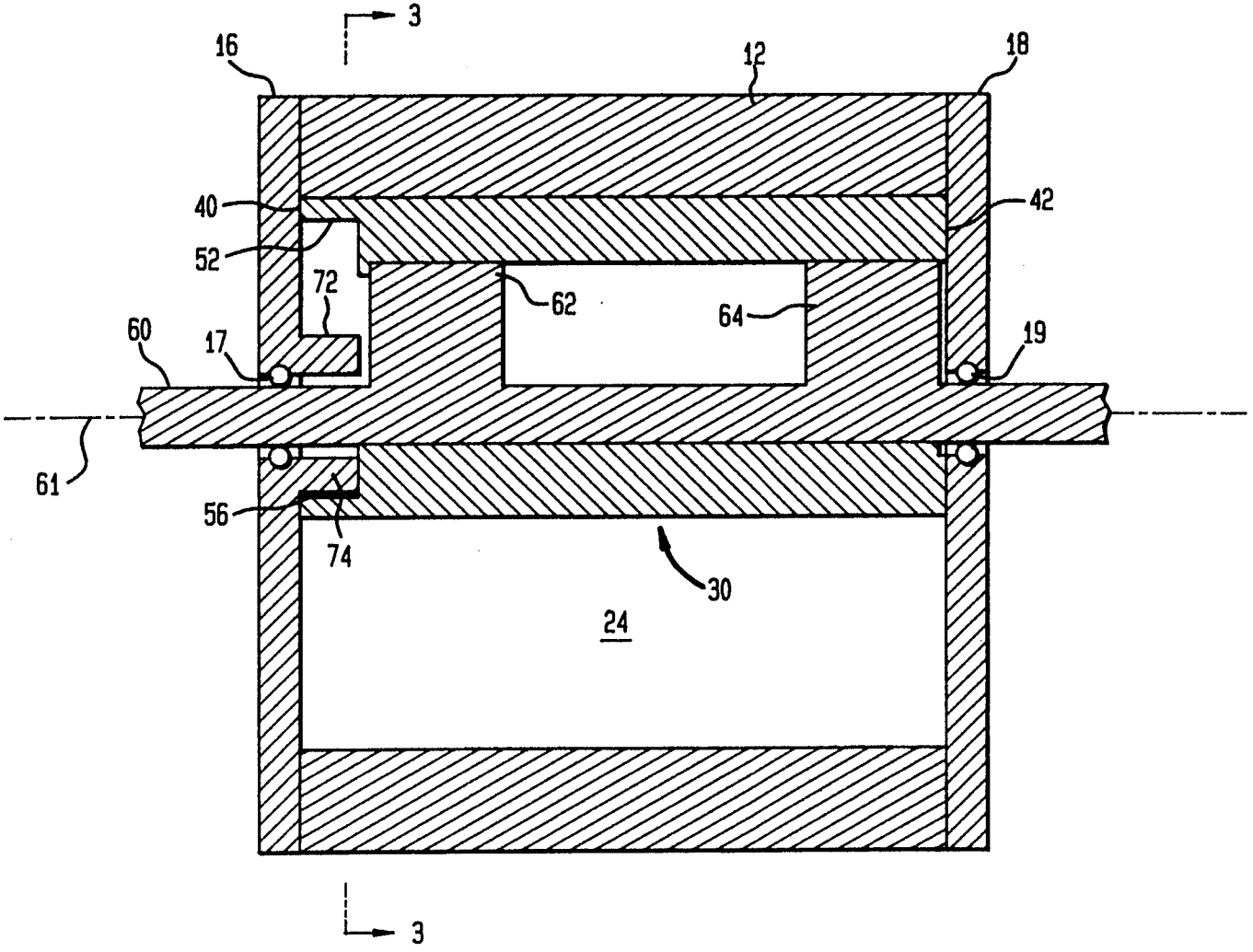
FIG. 2 is a cross-sectional side view of the gearless two-lobe rotor rotary machine of FIG. 1.
Figure 3:
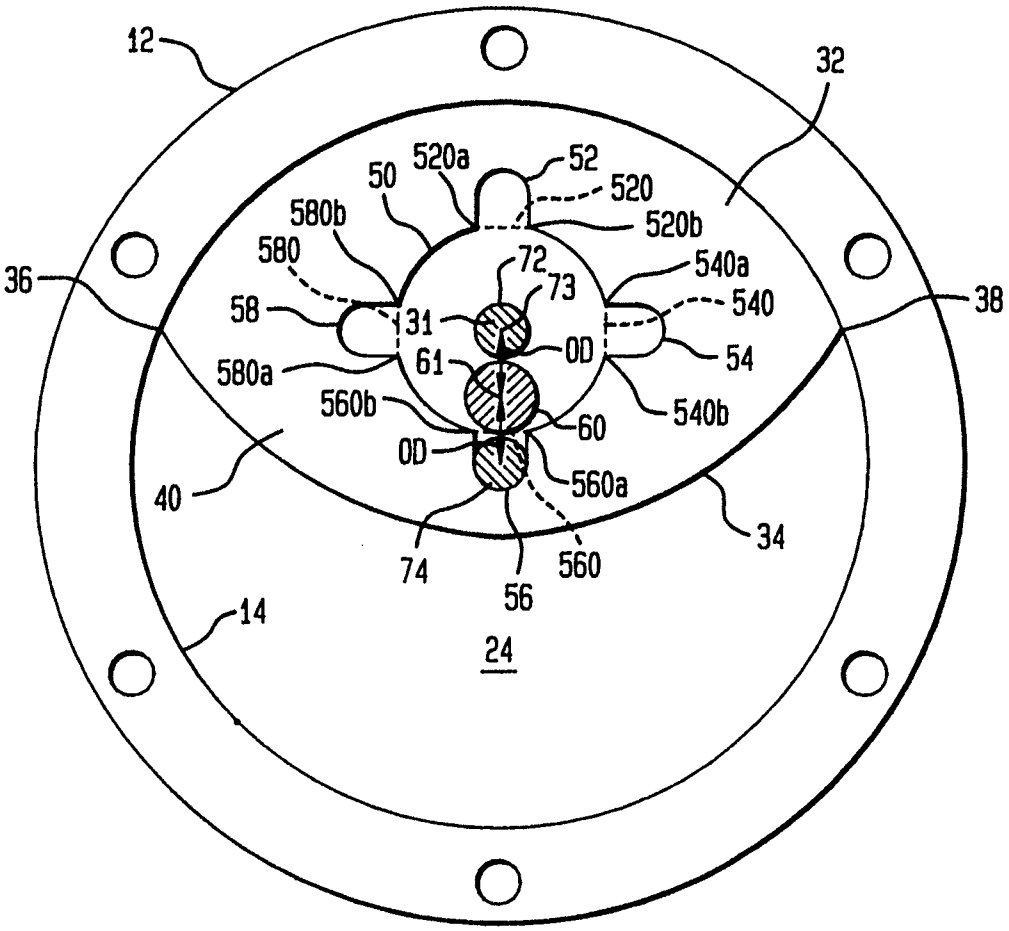
FIG. 3 is a head-on sectional view of the gearless two-lobe rotor rotary machine of FIG. 1 taken along line 3—3 of FIG. 2.

Referring now to the drawings, and more particularly to FIGS. 1–3 where like reference numerals are used for common elements, there is indicated generally at 10 one embodiment of a rotary machine in accordance with the present invention. Machine 10 includes housing 12 having inwardly facing annular wall 14. Housing 12 further has end walls 16 and 18 secured thereto by means of, for example, bolts 20. Thus, when joined together, annular wall 14 and walls 16 and 18 define machine chamber 24.

Machine 10 also includes two-lobe lenticular rotor assembly 30 having curved faces 32 and 34 meeting at symmetrically opposed apices 36 and 38 with end faces 40 and 42 extending between curved faces 32 and 34. End faces 40 and 42 are typically parallel to one another. Rotor assembly 30 is disposed in machine chamber 24 for eccentric rotation therein as will be explained further below. Rotor assembly 30 has a hole 50 passing through end faces 40 and 42. The size and shape of hole 50 will be discussed further below. For purpose of the illustrated embodiment, hole 50 is cylindrical. Continuous with hole 50 at end face 40 are four slots 52, 54, 56 and 58 arranged symmetrically about a center 31 of rotor assembly 30. Each slot 52, 54, 56 and 58 is defined by respective open end 520, 540, 560 and 580 that extends from hole 50 in a radial fashion away from rotor assembly center 31.

Machine 10 also includes a shaft 60 journaled in bearings 17 and 19 (shown only in FIG. 2 for ease of illustration) in end walls 16 and 18, respectively. Accordingly, hole 50 must be sized/shaped to permit the passage shaft 60. Shaft 60 has a longitudinal axis 61 that is offset from center 31 of rotor assembly 30 by a distance OD. One or more eccentric bearings depend from shaft 60 to form the driving engagement between annular wall 14 and shaft 60. The number of eccentric bearings depends generally on the length of rotor assembly 30 in terms of the distance between end faces 40 and 42. Interaction between guide member assembly 70 and slots 52, 54, 56 and 58 (as will be explained further below) introduces forces that can slightly misalign rotor assembly 30 along shaft 60. A relatively short rotor assembly is kept aligned by oil seals (not shown for ease of illustration), while a relatively long rotor assembly must maintain alignment with proper eccentric bearing placement at either end of the rotor assembly. Thus, by way of example, a pair of eccentric bearings 62 and 64 are shown depending from shaft 60.

It is to be understood that machine 10 represents a positive displacement machine that can operate as a pump (i.e., shaft 60 is rotated to drive rotor assembly 30 by means of contact with rotating eccentric bearings 62 and 64) or an engine (i.e., gases expand within chamber 24 causing rotor assembly 30 to drive eccentric bearings 62 and 64 which in turn causes shaft 60 to rotate). It is further to be understood that the passage of fluids/gases into and out of chamber 24 can be implemented in any one of a variety of ways well known in the art. Accordingly, discussion and description relating to this aspect of the operation of machine 10 have been omitted.

In order to control movement of rotor assembly 30, a rotor guide assembly 70 is provided at one end of chamber 24. By way of example, rotor guide assembly 70 is shown mounted in mounting cylinder 160 formed on end wall 16. Rotor guide assembly 70 can be held in mounting cylinder 160 by means cover 162 which is secured to mounting cylinder 160 by screws 164.

Rotor guide assembly 70 includes guide posts 72 and 74 which extend in parallel fashion towards end face 40 of rotor assembly 30. The length of guide posts 72 and 74 is such that they can engage slots 52, 54, 56 and 58 in a prescribed fashion during eccentric rotation of rotor assembly 30. Thus, guide posts 72 and 74 will impact the size and shape of hole 50 as will be discussed further below. It is sufficient at this point in the description to say that guide posts 72 and 74 are configured to allow the passage and rotation of shaft 60 in central bore 71 of rotor guide assembly 70. More specifically, regardless of the size or shape of guide posts 72 and 74, respective center longitudinal axes 73 and 75 of guide posts 72 and 74 are each maintained at the offset distance OD from longitudinal axis 61 of shaft 60. (Note that for the rotor position shown in FIG. 3, rotor assembly center 31 and longitudinal axis 73 are coincident.) Further, longitudinal axes 61, 73 and 75 are coplanar, i.e., guide posts 72 and 74 are 180° apart.

Figure 4:
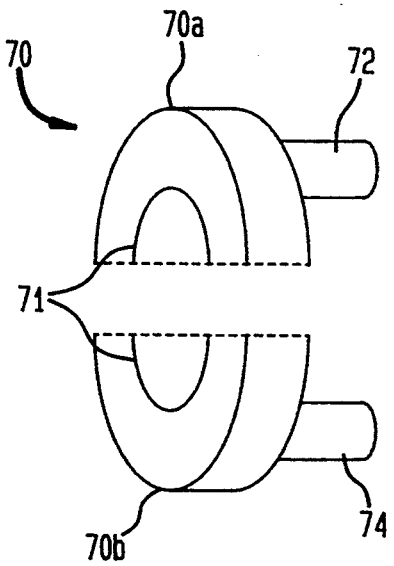
FIG. 4 is a perspective view of an alternative rotor guide assembly configuration.
Figure 8:
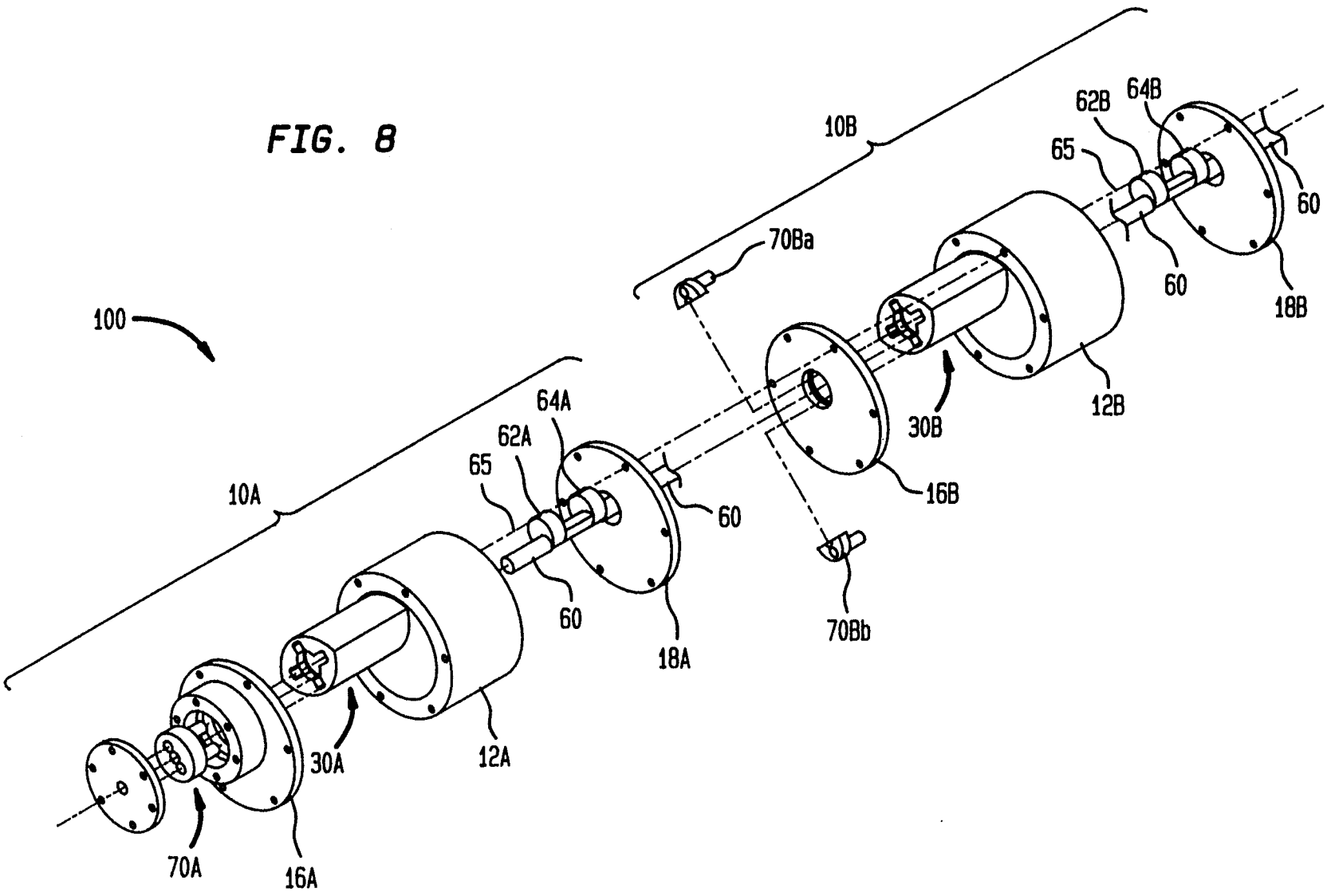
FIG. 8 is an exploded perspective view of a rotary machine having multiple gearless two-lobe rotor rotary machines cooperating with one shaft.

Rotor guide assembly can be made as a single unit as shown. Alternatively, guide posts 72 and 74 could be integrated with end wall 16. In still another alternative, rotor guide assembly 70 can be made in two halves **70*a* and 70*b* cut through central bore 71 as shown in FIG. 4. Such a configuration would facilitate assembly in the case of a rotary machine having a single shaft and multiple chamber/rotor/rotor guide assembly units cooperating with the single shaft. (This embodiment of the present invention is shown in FIG. 8** and will be described further below).

The size/shape relationships between shaft 60, guide posts 72 and 74, and hole 50 will now be described with continued reference to FIG. 3 and reference to FIG. 5. As illustrated, each of shaft 60 and guide posts 72 and 74 is cylindrical. Shaft 60 has a radius $R_S < OD$ and each of guide posts 72 and 74 has a radius R such the $R < R_S < OD$. Each slot 52, 54, 56 and 58 is sized to tangentially receive guide posts 72 and 74. The size requirements of hole 50 that permit passage of shaft 60 with optimum engagement of guide posts 72 and 74 with slots 52, 54, 56 and 58 is best understood by reviewing the operation of the rotary machine of the present invention.

Figure 5:
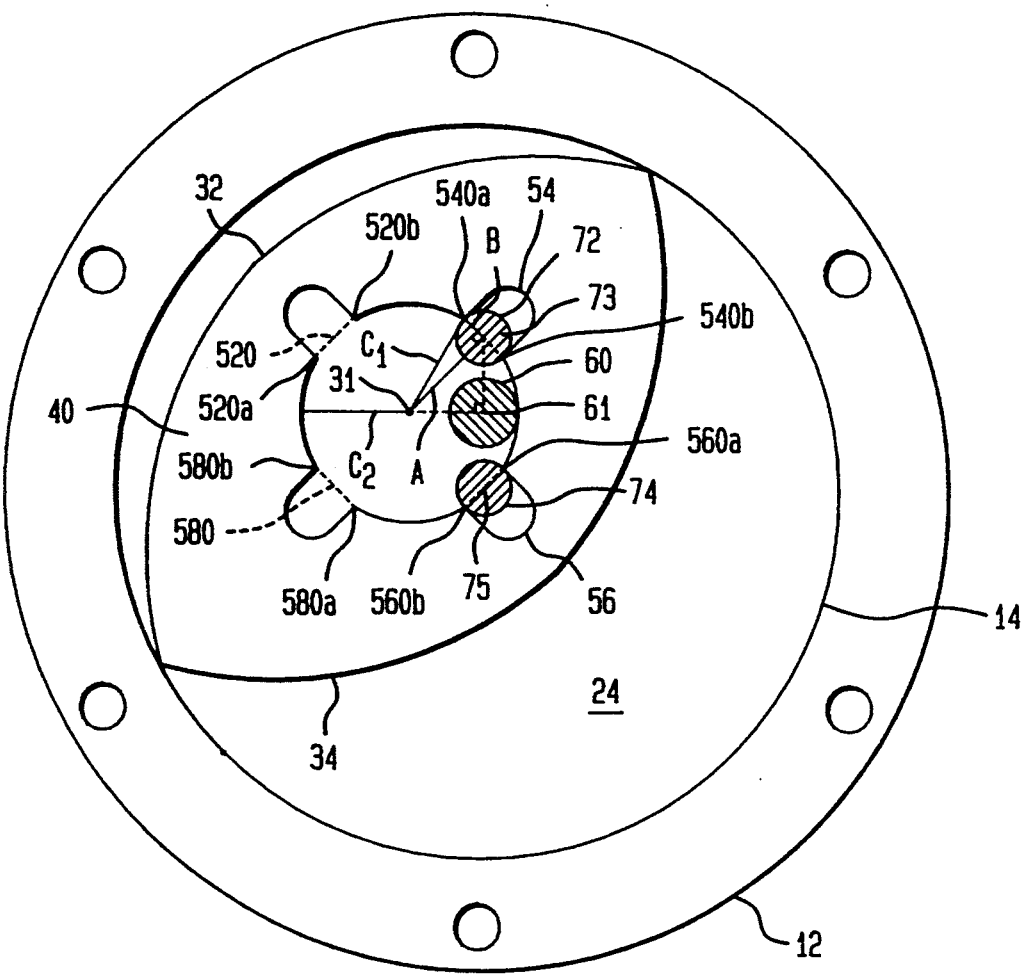
FIG. 5 is a head-on sectional view (similar to FIG. 3) showing the position of the rotor assembly after undergoing 45° of rotation.

From the position shown in FIG. 3, rotor assembly 30 is rotated about shaft 60 45° to the position shown in FIG. 5. During such rotation, guide post 74 slides out of engagement with slot 56 while guide post 72 approaches engagement with slot 540. At exactly 45° of rotation, guide post 72 is tangentially engaged with slot 54 while guide post 74 is tangentially engaged with slot 56. This insures that there is guide post/slot engagement throughout the entire rotation of rotor assembly 30.

To achieve this type of guide post/slot engagement, hole 50 must extend outward from rotor assembly center 31 a distance $C_1$ to respective edges **520*a*/520*b*, 540*a*/540*b*, 560*a*/560*b* and 580*a*/580*b* of open ends 520, 540, 560 and 580** where $$C_1 = \sqrt{A^2 + B^2} \tag{1}$$

"A" is the distance from rotor assembly center 31 to the center of open end 540. Geometrically, "A" is the hypotenuse of a right isosceles triangle whose vertices are: 1) the center (which is also longitudinal axis 73 in FIG. 5) of a line connecting edges **540*a* and 540*b*, 2) longitudinal axis 61, and 3) rotor assembly center 31**. Since the legs of such a triangle are each equal to OD, $A = \sqrt{2}\,OD$. (Note that A is the same for each of the remaining slots.)

"B" is equal to the distance from either edge **540*a* or 540*b* to the center (i.e., longitudinal axis 73 in FIG. 5) of the line connecting edges 540*a* and 540*b*. Since guide post 72 is in tangential engagement with slot 54 in the position shown in FIG. 5**, B is equal to the guide post radius R. (Note that B is the same for each of the remaining slots.) Thus, $$C_1 = \sqrt{2(OD)^2 + R^2} \tag{2}$$

for $$R < R_S \leqq \sqrt{(OD^2 + R^2 - \sqrt{2}\ OD{*}R)} \tag{3}$$

Geometrically, the maximum value for $R_S$ for a given R and OD is defined as a radius extending from longitudinal axis 61 of shaft 60 to a respective near edge, e.g., either of edges 540*b* and 560*a* in FIG. 5. The maximum value for $R_S$ is $$R_{S-MAX} = \sqrt{(OD^2 + R^2 - \sqrt{2}\ OD*R)} \quad (4)$$

and is determined using well known geometric principles.

The size and shape of hole 50 between adjacent slots must meet certain minimum requirements depending on the relative sizes of shaft 60 and guide posts 72 and 74. For the case where $R_S \geqq R$, (this includes the illustrated example), the distance $C_2$ from center 31 of rotor assembly 30 to the area between adjacent slots must satisfy the relationship $$C_2 \geqq C_1 \quad (5)$$

Figure 6:
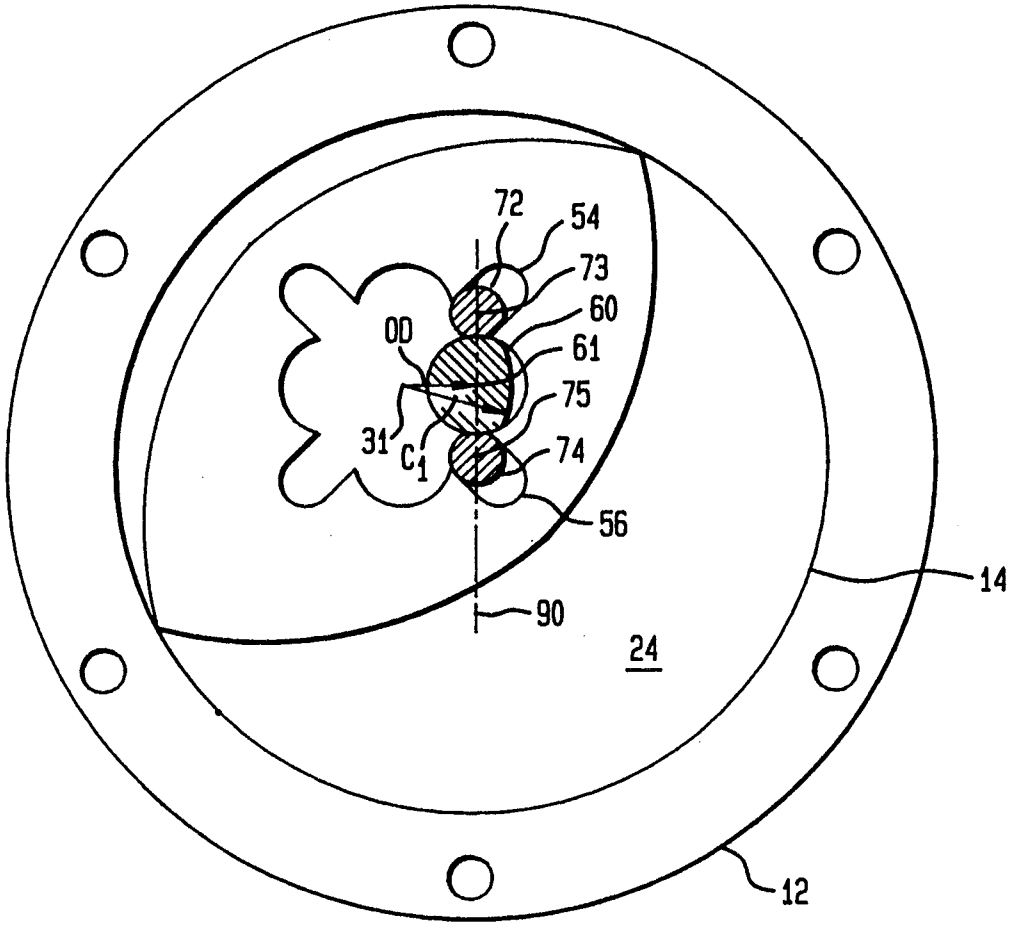
FIG. 6 is a head-on sectional view (similar to FIG. 5) depicting the case where the radius of the shaft is greater than the offset distance to the center of the rotor assembly.

However, the present invention can accommodate a larger shaft for increased torque handling. For example, when $R_S > (C_1 - OD)$, then $C_2 > (C_1 = OD)$ where $$C_2 = (OD + R_S) \quad (6)$$

as shown in the embodiment of FIG. 6. Further, when $R_S > C_1$, shaft 60 must be shaped such that its radius in the plane of slots 52, 54, 56 and 58 clears each guide slot. This is accomplished by shaping the portion of shaft 60 that communicates with the area defined by $C_2$ such that shaft 60 in this area does not extend beyond $C_1$. Note that additional advantages achieved by rotor material removal out to $C_2$ are that assembly is facilitated and the overall weight of rotor assembly 30 is reduced.

As $R_S$ approaches its maximum value for a given R and OD, it is necessary to shape guide posts 72 and 74 to provide for rotational clearance of shaft 60. The configuration for the maximum value of $R_S$ is shown in FIG. 6 where each of guide posts 72 and 74 is routed to provide for such rotational clearance while still maintaining slot engagement. For $R_S$ equal to its maximum value, routing of each guide post 72 and 74 occurs within the respective 90° quadrant centered about imaginary line 90 connecting center longitudinal axes 61, 73 and 75.

Figure 7:
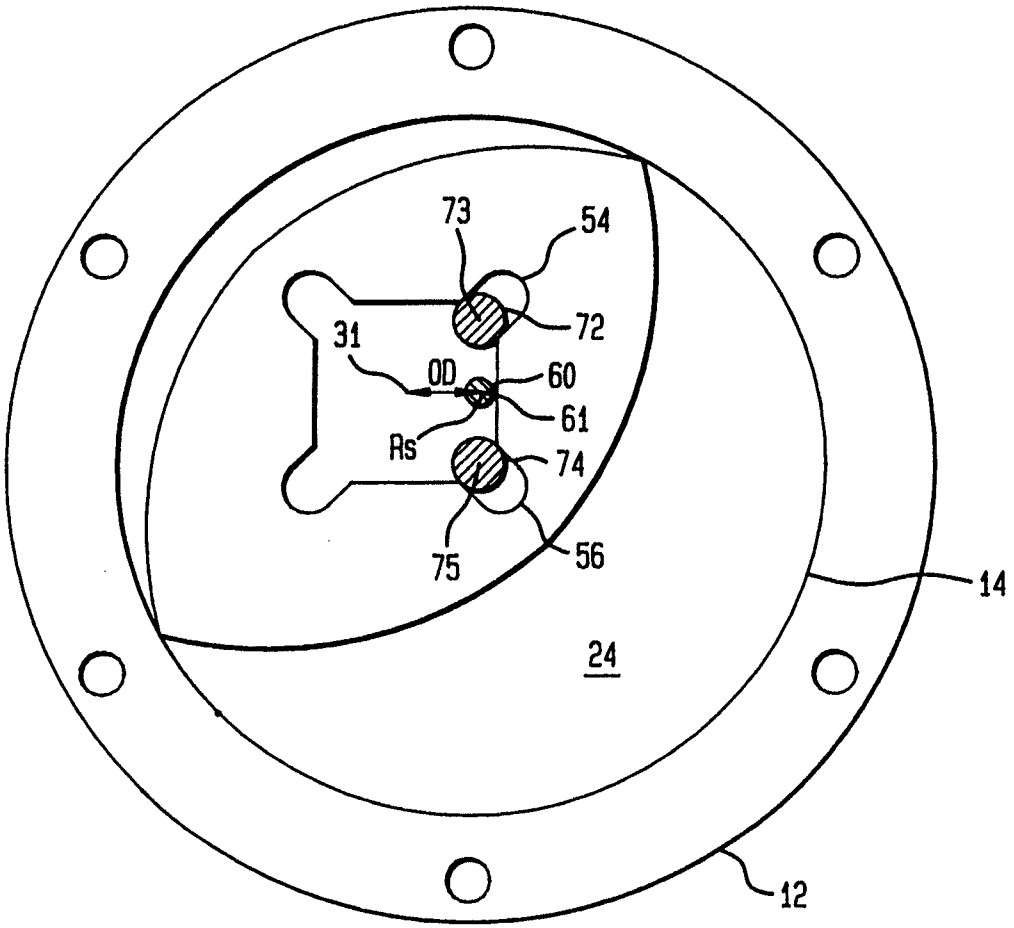
FIG. 7 is a head-on sectional view (similar to FIG. 5) depicting the case where the radius of the shaft is less than the radius of each guide post.

Finally, for the case where $R_S < R$, $C_1$ must still be equal to that given in equation (2) while $C_2$ can be equal to or greater than $(OD + R_S)$. This case is shown in FIG. 7. The use of larger guide posts relative to shaft size can be appropriate where machine 10 will undergo rapid fluctuations in rotational speed. Conversely, smaller guide posts suffice when machine 10 rotates at fairly constant speeds.

Although the present invention has been described relative to a single chamber/rotor/rotor guide assembly, it is not so limited. Indeed, one of the great advantages of the present invention is that multiple chambers with corresponding rotor/rotor guide assemblies can cooperate with a single shaft since the structure of the present invention provides for the passing through and rotational support of the shaft on either side of the machine chamber. A rotary machine built in this fashion is shown in FIG. 8 and referenced generally by numeral 100. Machine 100 utilizes a single shaft 60 that supports multiple rotary machines 10A, 10B, . . . each of which has a structure similar to that described above for single rotary machine 10. Note that the rotor guide assemblies beginning with guide assembly 70B are assembled as two halves 70B*a* and 70B*b* to facilitate assembly. As shown, eccentric bearing pairs 62A/64A, 62B/64B, . . . share a common longitudinal axis 65. Thus, each rotor assembly 30A, 30B, . . . would have a common machine stroke, i.e., the rotor assemblies are in-phase with one another. However, this need not be the case as each respective longitudinal axis of each eccentric bearing pair could also be offset from one another, i.e., the rotor assemblies are out-of-phase with one another, so that a specific balance or more constant torque curve could be achieved.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A rotary machine comprising:

a housing with spaced apart end walls for defining a chamber;

a two-lobe lenticular rotor assembly having curved faces meeting at symmetrically opposed apices, said rotor assembly having two parallel end faces extending between said curved faces, each of said parallel end faces facing one of said end walls, said rotor assembly disposed in said chamber for eccentric rotation therein, said rotor assembly having a hole passing through a central portion thereof through said parallel end faces, said rotor assembly further having four slots in one of said parallel end faces arranged symmetrically about a center of said rotor assembly, each of said slots having two edges defining an open end continuous with said hole, each of said slots extending radially outward from said hole;

a rotor guide assembly extending from one of said end walls, said rotor guide assembly including first and second guide posts, each of said first and second guide posts being cylindrical in shape over at least a substantial portion thereof, each of said first and second guide posts having a radius R over said substantial portion, each of said first and second guide posts extending in parallel fashion toward said one of said parallel end faces having said slots, said first and second guide posts engaging said slots during said eccentric rotation of said rotor assembly, each of said first and second guide posts having a center longitudinal axis;

a shaft having a center longitudinal axis, said shaft extending through said hole with said center longitudinal axis of said shaft being offset from said center of said rotor assembly by an offset distance OD, said shaft extending through said chamber and rotatably mounted in each of said end walls, said shaft further being centered between said first and second guide posts, such that said center longitudinal axis of said shaft and each of said center longitudinal axes of said first and second guide posts are in coplanar alignment, and a distance from said center longitudinal axis of said shaft to each of said center longitudinal axes of said first and second guide posts being equal to said offset distance OD, said shaft including at least one eccentric bearing for forming driving contact between said shaft and said rotor assembly; and said hole being sized so that a distance between said center of said rotor assembly to each of said two edges for each of said open ends of said slots is equal to $$\sqrt{2\,(OD)^2 + R^2}\,.$$

2. A rotary machine as in claim 1 wherein said shaft has a radius equal to or greater than said radius R, said hole further being sized so that a distance between said center of said rotor assembly to areas of said rotor assembly between adjacent ones of said open ends is equal to or greater than $$\sqrt{2\,(OD)^2 + R^2}\,.$$

3. A rotary machine as in claim 1 wherein said shaft has a radius r less than said radius R, said hole further being sized so that a distance between said center of said rotor assembly to areas of said rotor assembly between adjacent ones of said open ends is equal to or greater than $$(OD+r).$$

4. A rotary machine as in claim 2 wherein each of said first and second guide posts is shaped to provide for rotational clearance of said shaft.

5. A rotary machine as in claim 3 wherein each of said first and second guide posts is entirely cylindrical in shape.

6. A rotary machine as in claim 1 wherein each of said slots is further defined by side walls extending radially outward from said two edges, and wherein said side walls associated with adjacent ones of said slots are in a 90° relationship with one another.

7. In a rotary machine of the type having a chamber with an interior annular wall, and a shaft extending through said chamber, said shaft having an eccentric bearing, the improvement comprising:

a two-lobe lenticular rotor assembly having curved faces meeting at symmetrically opposed apices and disposed in said chamber for eccentric rotation therein, said rotor assembly having two parallel end faces extending between said curved faces, said rotor assembly having a hole passing through a central portion thereof through said parallel end faces for receiving said shaft wherein said eccentric bearing forms driving contact between said shaft and said rotor assembly, said rotor assembly further having four slots in at least one of said parallel end faces arranged symmetrically about a center of said rotor assembly, each of said slots having two edges defining an open end continuous with said hole, each of said slots extending radially outward from said hole, said center of said rotor assembly being offset from a center longitudinal axis of said shaft by an offset distance OD;

a rotor guide assembly located at least at one end of said chamber, said rotor guide assembly including first and second guide posts, each of said first and second guide posts being cylindrical in shape over at least a substantial portion thereof, each of said first and second guide posts having a radius R over said substantial portion, each of said first and second guide posts extending in parallel fashion toward said one of said parallel end faces having said slots, said first and second guide posts engaging said slots during said eccentric rotation of said rotor assembly, each of said first and second guide posts having a center longitudinal axis, said first and second guide posts positioned such that said center longitudinal axis of said shaft and each of said center longitudinal axes of said first and second guide posts are in coplanar alignment wherein a distance from said center longitudinal axis of said shaft to each of said center longitudinal axes of said first and second guide posts being equal to said offset distance OD; and said hole being sized so that a distance between said center of said rotor assembly to each of said two edges for each of said open ends of said slots is equal to $$\sqrt{2\,(OD)^2 + R^2}\,.$$

8. In a rotary machine of the type described in claim 7, wherein said shaft has a radius equal to or greater than said radius R, the improvement further comprising said hole being sized so that a distance between said center of said rotor assembly to areas of said rotor assembly between adjacent ones of said open ends is equal to or greater than $$\sqrt{2\,(OD)^2 + R^2}\,.$$

9. In a rotary machine of the type described in claim 7, wherein said shaft has a radius r less than said radius R, the improvement further comprising said hole being sized so that a distance between said center of said rotor assembly to areas of said rotor assembly between adjacent ones of said open ends is equal to or greater than $$(OD+r).$$

10. In a rotary machine of the type described in claim 8, the improvement further comprising each of said first and second guide posts being shaped to provide for rotational clearance of said shaft.

11. In a rotary machine of the type described in claim 9, the improvement further comprising each of said first and second guide posts being entirely cylindrical in shape.

12. In a rotary machine of the type described in claim 7, the improvement further comprising each of said slots being defined by side walls extending radially outward from said two edges, wherein said side walls associated with adjacent ones of said slots are in a 90° relationship with one another.

13. A rotary machine comprising:

a plurality of housings, each of said plurality of housings having spaced apart end walls for defining a chamber within each of said plurality of housings;

a two-lobe lenticular rotor assembly disposed in each said chamber for eccentric rotation therein, each said rotor assembly having corresponding curved faces meeting at symmetrically opposed apices, each said rotor assembly having corresponding parallel end faces extending between said corresponding curved faces, each of said corresponding parallel end faces facing one of said end walls of a corresponding one of said plurality of housings, each said rotor assembly having a corresponding hole passing through a central portion thereof through said corresponding parallel end faces, each said rotor assembly further having a corresponding center and four corresponding slots in one of said corresponding parallel end faces arranged symmetrically about said corresponding center, each of said corresponding slots having two edges defining an open end continuous with said corresponding hole, each of said corresponding slots extending radially outward from said corresponding hole;

a rotor guide assembly extending from one of said end walls of each of said plurality of housings, each said rotor guide assembly including corresponding first and second guide posts, each of said corresponding first and second guide posts being cylindrical in shape over at least a substantial portion thereof, each of said corresponding first and second guide posts having a corresponding radius R over said substantial portion, each of said corresponding first and second guide posts extending in parallel fashion toward said one of said corresponding parallel end faces having said corresponding slots, said corresponding first and second guide posts engaging said corresponding slots during said eccentric rotation of each said rotor assembly, each of said corresponding first and second guide posts having a center longitudinal axis;

a shaft having a center longitudinal axis, said shaft extending through each said chamber and each corresponding hole of each said rotor assembly with said center longitudinal axis of said shaft being offset from said corresponding center of each said rotor assembly by an offset distance OD, said shaft rotatably mounted in each of said end walls of each of said plurality of housings, said shaft further being centered between each said corresponding first and second guide posts such that said center longitudinal axis of said shaft and each of said center longitudinal axes of said corresponding first and second guide posts are in coplanar alignment, wherein a distance from said center longitudinal axis of said shaft to each of said center longitudinal axes of said corresponding first and second guide posts is equal to said offset distance OD, said shaft including a corresponding eccentric bearing depending therefrom within each said rotor assembly for forming driving contact between said shaft and each said rotor assembly; and each said corresponding hole being sized based on said offset distance OD and said corresponding radius R so that a distance between said corresponding center of each said rotor assembly to each of said two edges for each of said open ends of said corresponding slots is equal to $$\sqrt{2\,(OD)^2 + R^2}\ .$$

14. A rotary machine as in claim 13 wherein each of said corresponding first and second guide posts is shaped to provide for rotational clearance of said shaft.

15. A rotary machine as in claim 13 wherein each of said corresponding slots is further defined by side walls extending radially outward from said two edges, and wherein said side walls associated with adjacent ones of said corresponding slots are in a 90° relationship with one another.

16. A rotary machine as in claim 13 wherein each of said corresponding eccentric bearings depending from said shaft share a common longitudinal axis.

17. A rotary machine as in claim 13 wherein longitudinal axes of said corresponding eccentric bearings depending from said shaft are offset from one another.

* * * * *